US010427019B2

(12) United States Patent
Schmidt

(10) Patent No.: US 10,427,019 B2
(45) Date of Patent: Oct. 1, 2019

(54) MULTI-FUNCTIONAL THROWING GAME BOARD

(71) Applicant: David L. Schmidt, Zimmerman, MN (US)

(72) Inventor: David L. Schmidt, Zimmerman, MN (US)

(73) Assignee: David L. Schmidt, Zimmerman, MN (US)

( * ) Notice: Subject to any disclaimer, the term of this patent is extended or adjusted under 35 U.S.C. 154(b) by 0 days.

(21) Appl. No.: 15/914,799

(22) Filed: Mar. 7, 2018

(65) Prior Publication Data

US 2018/0256954 A1 Sep. 13, 2018

Related U.S. Application Data

(60) Provisional application No. 62/468,654, filed on Mar. 8, 2017.

(51) Int. Cl.

| | |
|---|---|
| ***A63B 67/06*** | (2006.01) |
| ***A63B 63/08*** | (2006.01) |
| ***A63F 9/02*** | (2006.01) |
| ***A63B 71/06*** | (2006.01) |

(52) U.S. Cl.

CPC ..... *A63B 67/06* (2013.01); *A63B 63/08* (2013.01); *A63B 2071/0694* (2013.01); *A63B 2210/50* (2013.01); *A63B 2225/682* (2013.01); *A63F 9/0204* (2013.01); *A63F 2009/0282* (2013.01); *A63F 2250/326* (2013.01)

(58) Field of Classification Search

CPC ..... A63B 67/06; F41J 13/00; A63F 9/02

See application file for complete search history.

(56) References Cited

U.S. PATENT DOCUMENTS

| | | | | |
|---|---|---|---|---|
| 4,961,586 | A * | 10/1990 | Conville | A63B 67/06 273/402 |
| 2016/0008689 | A1* | 1/2016 | Janeri | A63B 67/06 273/402 |
| 2016/0116260 | A1* | 4/2016 | Oh | F41J 13/00 273/410 |

* cited by examiner

*Primary Examiner* — Eugene L Kim
*Assistant Examiner* — Christopher A Glenn
(74) *Attorney, Agent, or Firm* — Steven M. Koehler; Westman, Champlin & Koehler, P.A

(57) ABSTRACT

A throwing game includes a panel assembly having a support frame and a first panel and a second panel supported by the support frame. The first panel has an aperture through a major surface. The first panel can be configured to be supported by the support frame in two positions, a first position wherein the first panel extends from the support frame forming a platform with a free end, and a second position wherein the first panel is parallel to the second panel. In addition or in the alternative, the second panel can be configured to be supported by the support frame in two positions, wherein in one position the second panel is adjacent the first panel and another position wherein the second panel is further from the first panel than when in said one position. The throwing game further includes a panel assembly support connected to the panel assembly to support at least one end of the panel assembly off a ground surface.

20 Claims, 19 Drawing Sheets

MULTI-FUNCTIONAL THROWING GAME BOARD

CROSS-REFERENCE TO RELATED APPLICATION

The present application is based on and claims the benefit of U.S. provisional patent application Ser. No. 62/468,654, filed Mar. 8, 2017, the content of which is hereby incorporated by reference in its entirety.

BACKGROUND

The discussion below is merely provided for general background information and is not intended to be used as an aid in determining the scope of the claimed subject matter.

The present disclosure relates to a bag toss game. Bag toss games are very popular and have been in use for many years. In a well-known form, the bag toss game involves two identical assemblies spaced apart from each other at a selected distance such as 25-35 feet apart from each other. Each assembly includes a smooth board or the like that is slightly inclined with a rear end slightly above the front end. The board includes an aperture typically located near the rear end. While standing proximate one of the assemblies, users, or teams, take turns throwing bags towards the other assembly trying to get each bag to fall through the aperture, or at least end up very close to the aperture. With time and practice one can become very adept at throwing the bags so as to achieve high scores, but this may take some of the fun out of the game. Therefore, making the game challenging to even a skilled player would be desirable.

SUMMARY

This Summary and the Abstract herein are provided to introduce a selection of concepts in a simplified form that are further described below in the Detailed Description. This Summary and the Abstract are not intended to identify key features or essential features of the claimed subject matter, nor are they intended to be used as an aid in determining the scope of the claimed subject matter. The claimed subject matter is not limited to implementations that solve any or all disadvantages noted in the Background.

A throwing game includes a panel assembly having a support frame and a first panel and a second panel supported by the support frame. The first panel has an aperture through a major surface. The first panel is supported by the support frame in two positions, a first position wherein the first panel extends from the support frame forming a platform with a free end, and a second position wherein the first panel is parallel to the second panel. The throwing game further includes a panel assembly support connected to the panel assembly to support at least one end of the panel assembly off a ground surface.

Another embodiment of a throwing game includes a panel assembly having support frame, and a first panel and a second panel supported by the support frame. The first panel has an aperture through a major surface. The second panel slides on the support frame between a first and second position, wherein the first position of the second panel locates the second panel adjacent the first panel, the second position of the second panel being further from the first panel than the first position. A panel assembly support connects to the panel assembly to support at least one end of the panel assembly off a ground surface.

Implementations may include one or more of the following features. The panel assembly support can be configured to hold one end of the panel assembly off the ground surface, or hold the panel assembly in an inclined orientation off the ground surface, or hold the support frame in a substantially perpendicular orientation to the ground surface. In one embodiment, the panel assembly support is pivotally connected to the support frame.

If not already configured as such, the first panel can be configured to pivot between two positions, or if desired, be removable from the support frame when moved between the two positions.

If not already configured as such, the second panel can be configured to move on the support frame. In particular, the second panel can slide on the support frame between two positions. In one position of the second panel the second panel is adjacent the first panel, while in the other position of the second panel the second panel is further from the first panel than when in said one position.

The throwing game can further include a third panel movably supported on the support frame. The third panel can slide on the support frame. If desired, the second panel and the third panel can slide in common channels formed in the support frame.

In a further embodiment, the second panel can include indicia in the form of a pattern allowing it to be used as the basis for another game. For instance, the indicia can be used as identifying marks for containers or the like commonly used in "pong".

Typically, the throwing game includes a second panel assembly and a second panel assembly support having the features of the panel assembly and panel assembly support, respectively. In one game configuration, the assemblies are spaced apart from each other, where the first panel can be oriented obliquely, parallel or perpendicular to the second panel as desired.

In another configuration, the panel assembly and the second panel assembly are configured to be connected together. In such a configuration, the panel assembly support and the second panel assembly support are configured to support the panel assembly and the second panel assembly when joined together in an elevated position above the ground surface. In this position, the indicia on the second panels of the panel assembly and the second panel assembly are at remote ends in the elevated position.

DESCRIPTION OF THE EXEMPLARY EMBODIMENT

Figure 1:
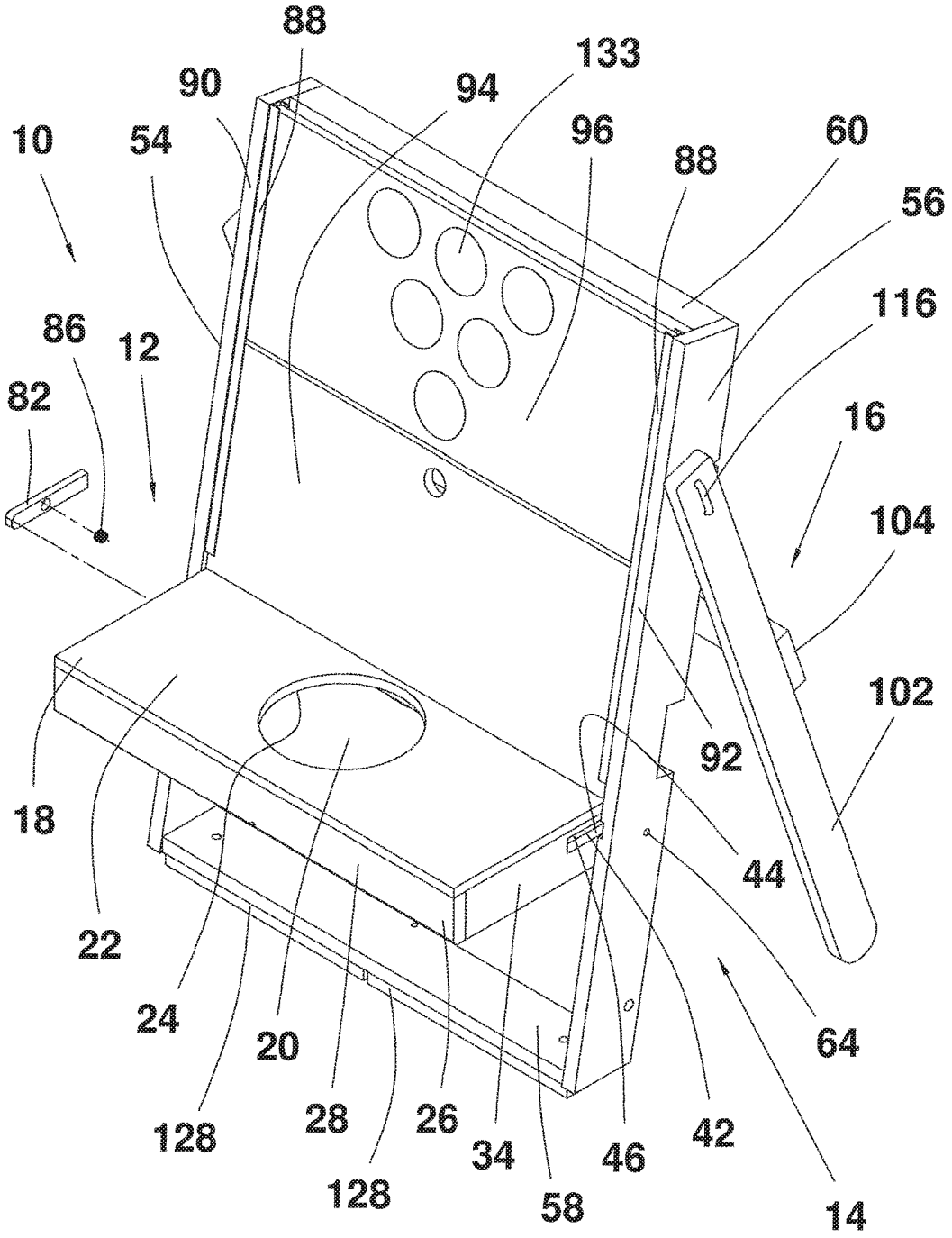
FIG. 1 is a front perspective illustration of a panel assembly for a bag toss game.
Figure 2:
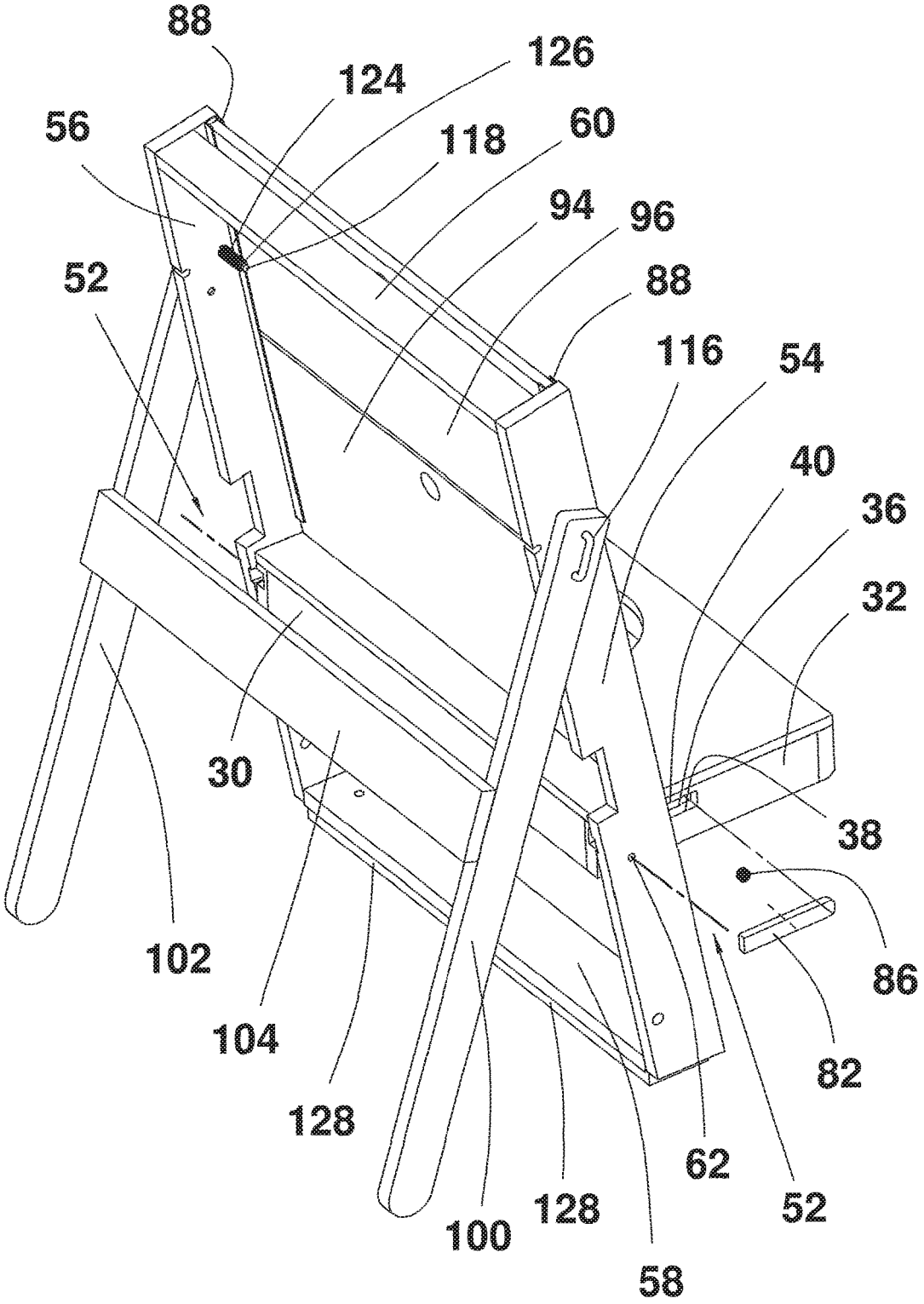
FIG. 2 is a rear illustration of the panel assembly.
Figure 3:
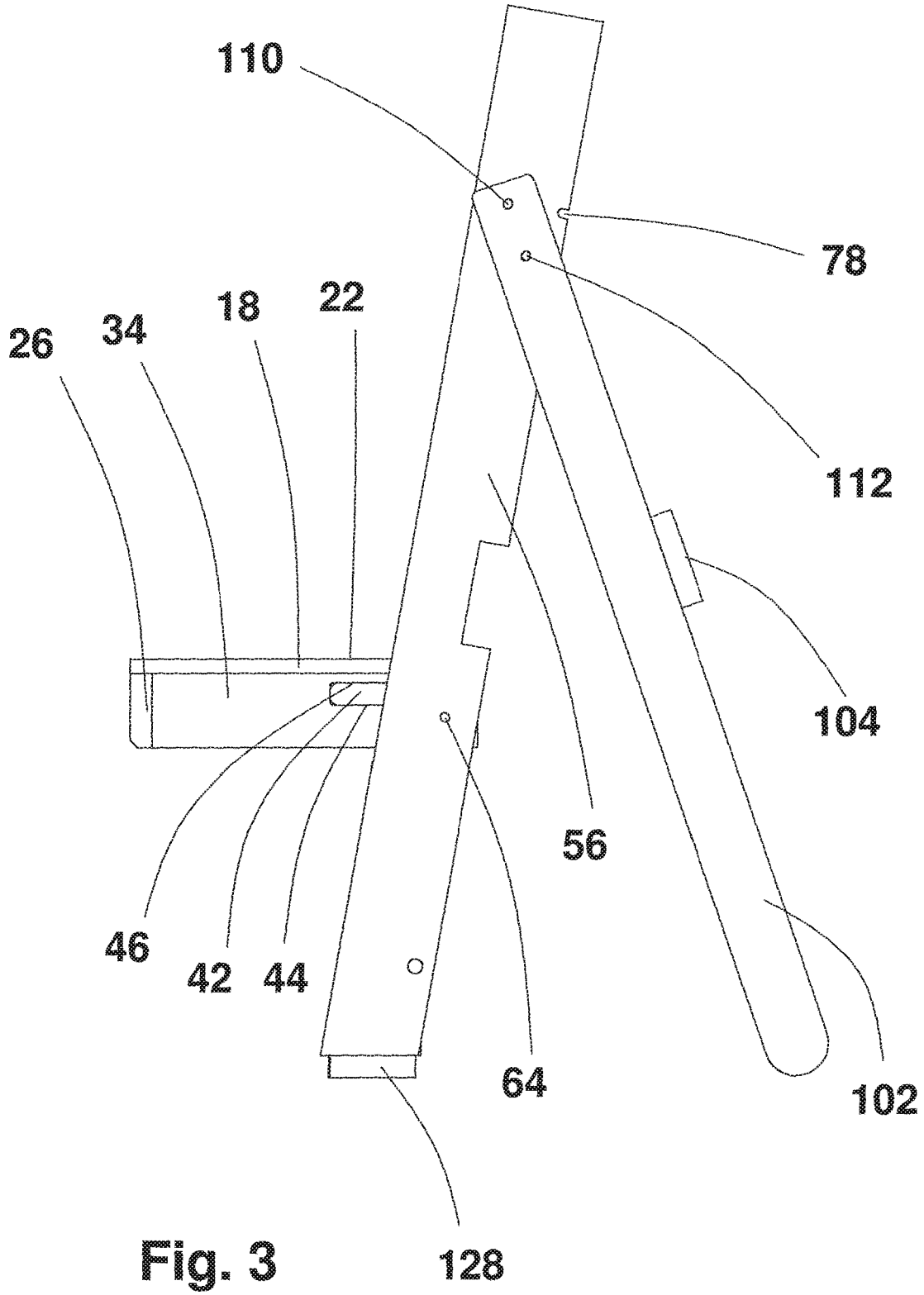
FIG. 3 is a right elevational view of the panel assembly.
Figure 4:
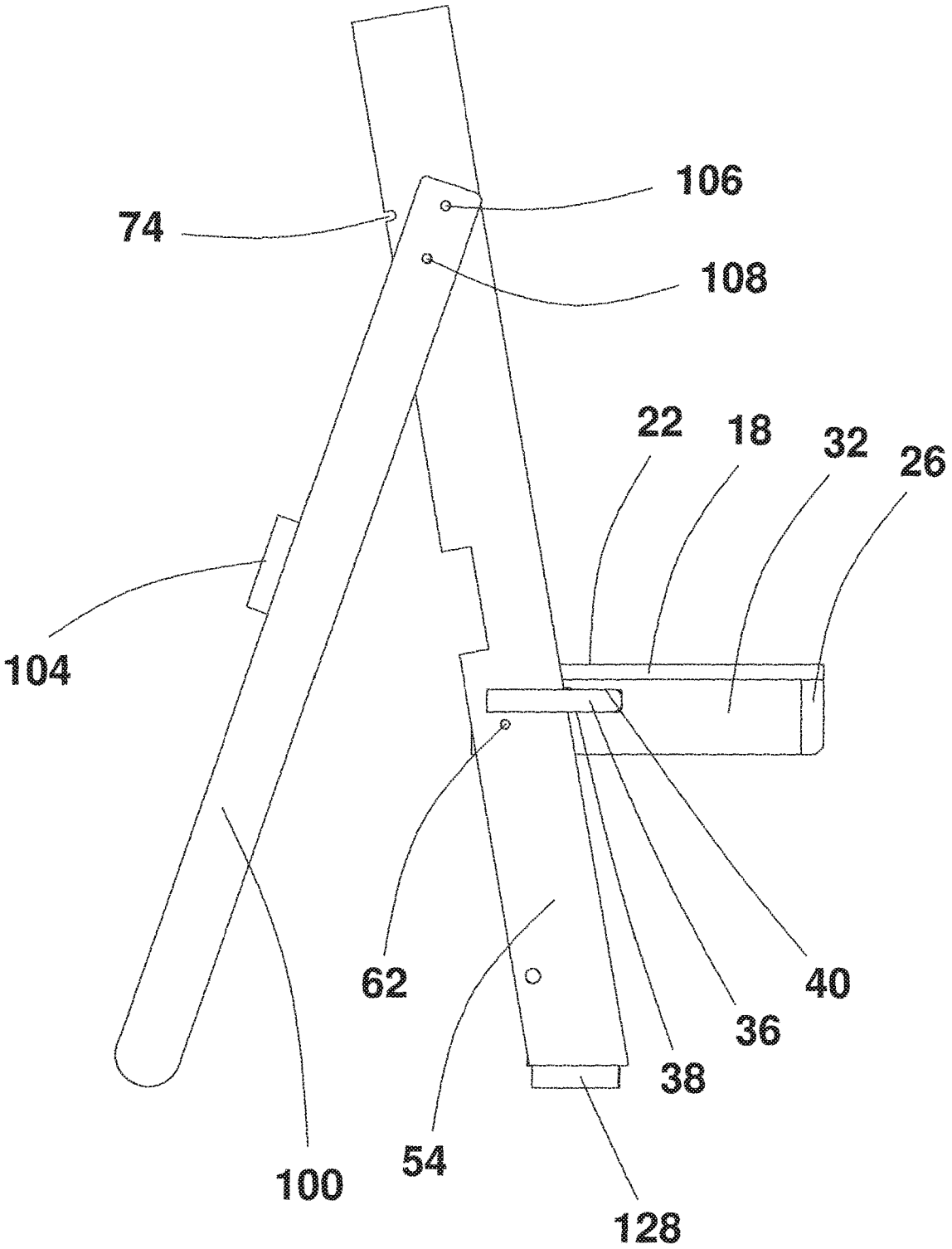
FIG. 4 is a left elevational view of the panel assembly.
Figure 5A:
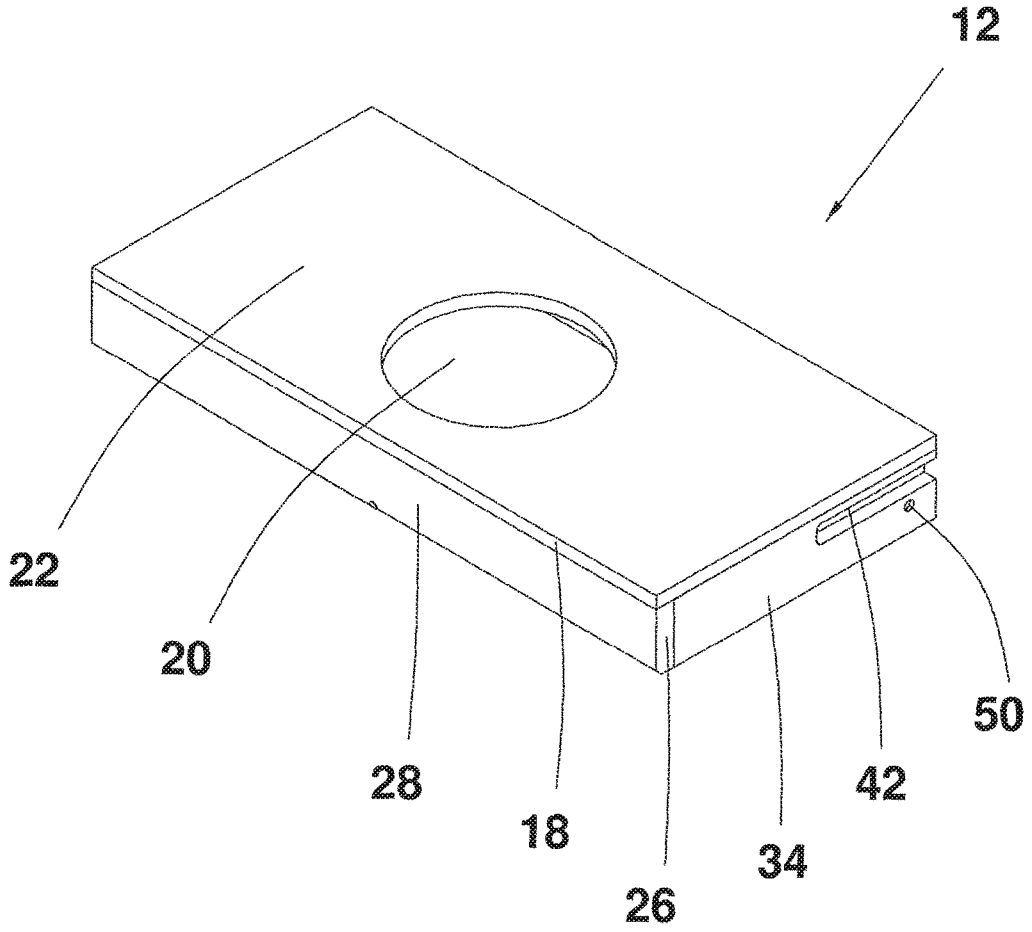
FIGS. 5*a* and 5*b* are a perspective views of a first panel.
Figure 5B:
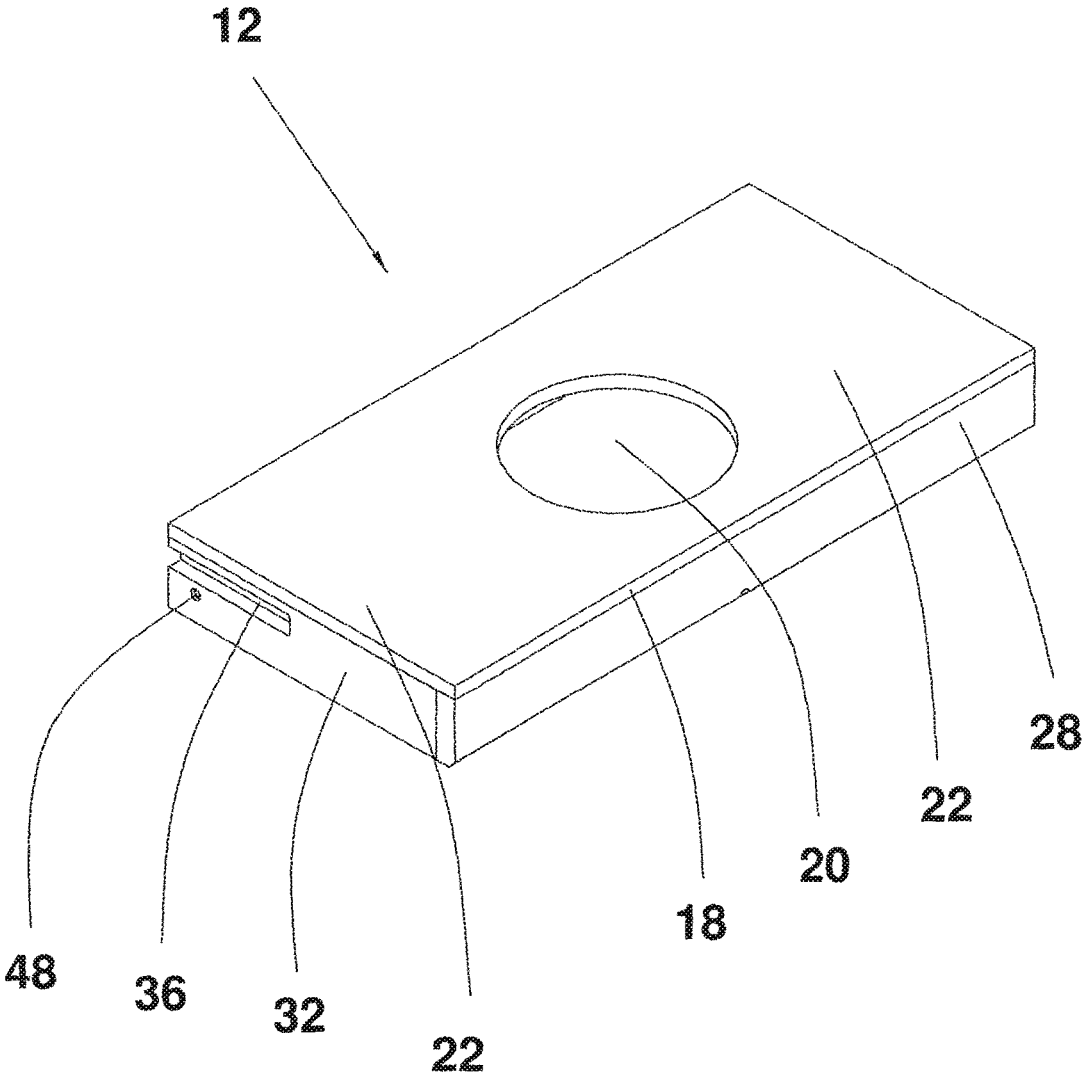

A bag toss game assembly indicated at 10 in FIG. 1 includes a panel assembly 12. The panel assembly 12 includes a hole or aperture 20 approximately in a center of a first panel 18 that is adequate for throwing items such as but not limited to bean bags through. The first panel 18 is rotatable or transversely mounted in a groove or other type aperture to a support frame 14. The support frame 14 is rotatably mounted to a rear leg assembly 16. The first panel 18 of the panel assembly 12 can be oriented parallel to the support frame 14 as well as in an outwardly or somewhat outwardly projection from the support frame 14. Because of the first panel's ability to move or pivot within a desired range, the bag toss game 10 can be manipulated in to multiple games or configurations.

In the embodiment illustrated, the support frame 14 also contains a set of "C" channel rails 88 and panels 94 and 96. The panels 94 and 96 can be manipulated to move within a desired range within the "C" channels 88. By altering the location of panels 94 and 96 the difficulty of the yard game 10 can be changed. In one embodiment, the channel rails 88 are open ended at one end thereof, allowing the one or more of the panels 94, 96 to be removed and a space or gap created between the remaining panel 94 or 96 and the first panel 18. The space or gap can be adjustable such as by varying the position of the remaining panel 94 or 96 from the first panel 18.

Referring to FIGS. 5*a*, 5*b*, 6*a* and 6*b*, the first panel 18 has an upper surface 22 and lower surface 24. The lower surface 24 is fixedly mated to the top surface of a front support rail 26. The front edge of the first panel 18 and a front face 28 of the front support rail 26 are aligned. The lower surface 24 and the front face 28 of the front support rail 26 are commonly perpendicular to each other. Attached to the lower surface 24 of the first panel 18 is a rear support rail 30. Support rails 26 and 30, face each other and are parallel to each other and perpendicular to the first panel 18. The first panel 18 has a pair of side support rails 32 and 34. The side support rails 32 and 34 are perpendicular to lower surface 24 of the first panel 18 as well as the front support rail 26 and the rear support rail 30. The first panel 18 along with the front support rail 26 and the rear support rail 30 as well as the two side support rails 32 and 34 form a box type structure. It should be understood, the afore-mentioned components such as the front support rail 26, rear support rail 30 and the pair of side support rails 32 and 34 can be made of individual pieces or, two or more can be formed integrally together from a single unitary body.

Located towards the rear of side support rail 32 is a recessed portion 36 having a lower surface 38 that is parallel to the first panel 18 and an upper surface 40 that runs parallel to the lower surface 38. The opposing side support rail 34 has a recessed portion 42 in an equal and opposite position of side support rail 32 having a lower surface 44 that is parallel to the first panel 18 and an upper surface 46 that runs parallel to 44. The recessed portion 36 and the recessed portion 42 face each other on a parallel plane and are of equal depth. Located towards the rear of side support rail 32 is a bore 48. Bore 48 is accompanied by an equal and opposite bore 50 in side support rail 34. Bores 48 and 50 create an axis 52 in which the first panel 18 and its support structure are allowed to rotate about if desired.

Figure 6A:
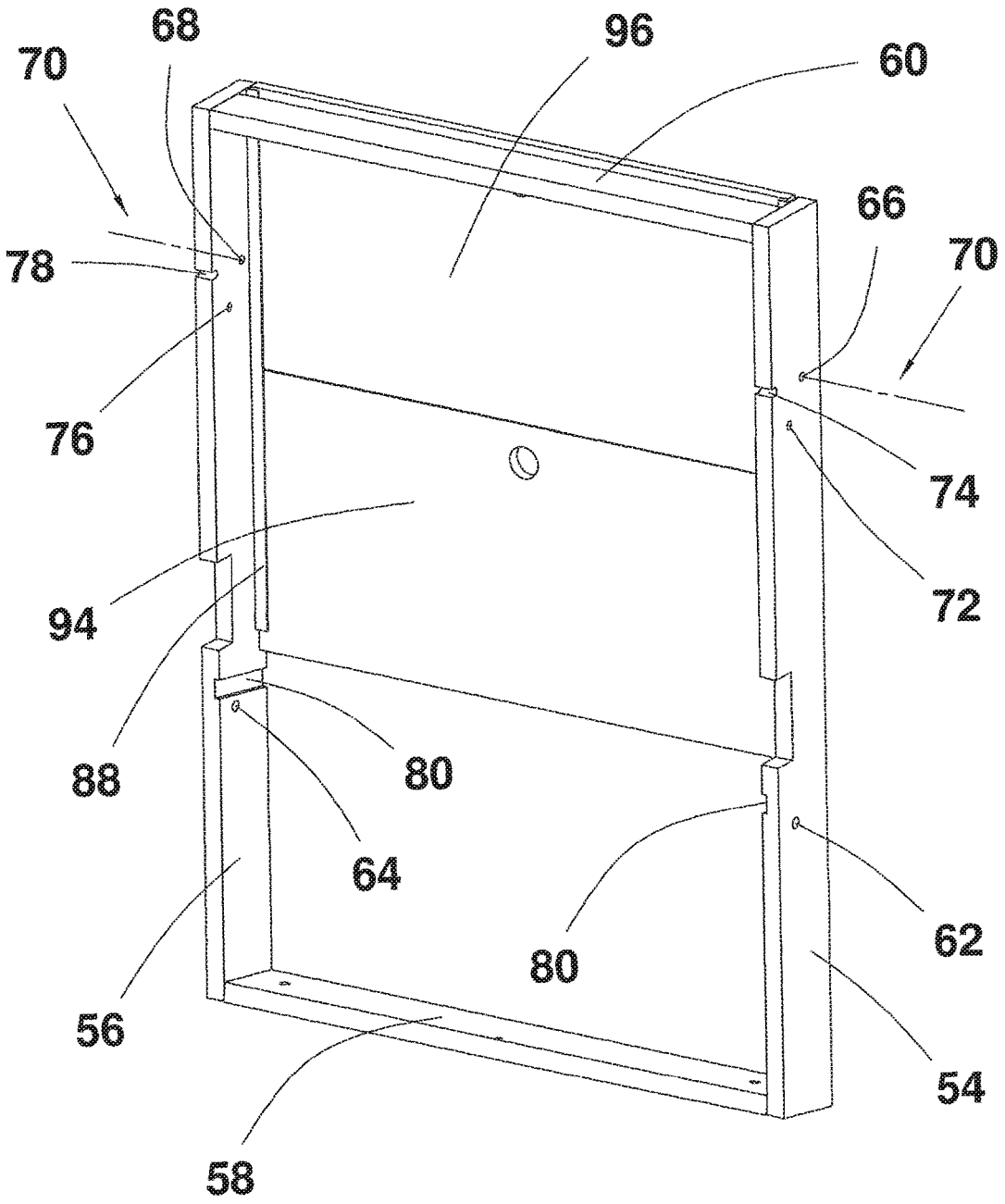
FIGS. 6*a* and 6*b* are perspective views of additional panels in a support assembly.
Figure 6B:
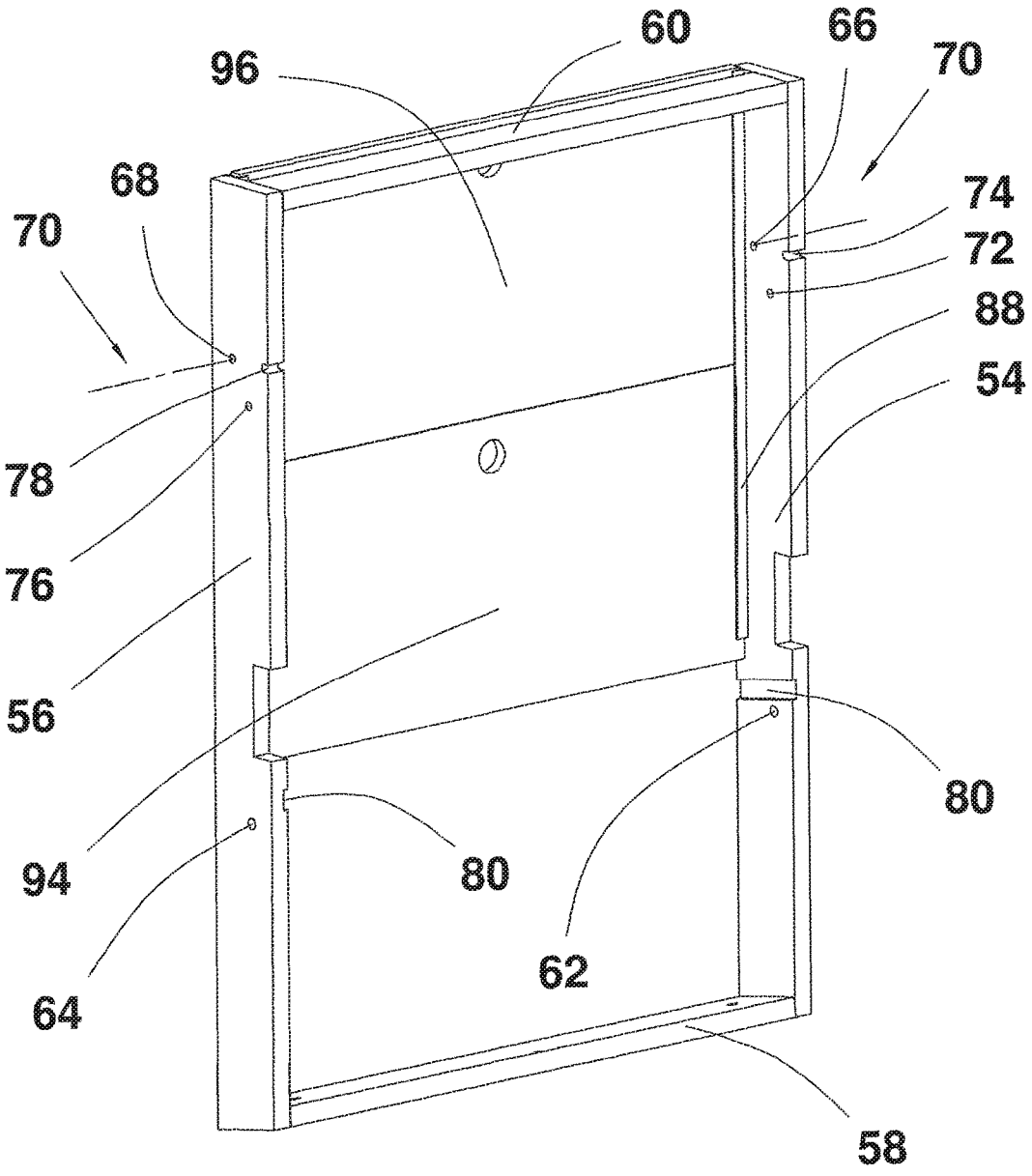

Referring to FIGS. 6*a* and 6*b*, the panel assembly 12 includes two panel assembly supports, a left panel assembly supports 54 and a right panel assembly supports 56. The panel assembly supports 54 and 56 are angled slightly backward from a vertical plane. Panel assembly supports 54 and 56 are fixedly attached to cross member 58 which runs along the lowest portion of the panel assembly supports 54 and 56. In addition to the lower cross member 58 there is an upper cross member 60 which runs parallel to the lower cross member 58. Cross member 60 runs at the highest portion of the panel assembly supports 54 and 56 and also perpendicular to panel assembly supports 54 and 56. It should be understood, the afore-mentioned components of support frame 14 such as portions of panel assembly supports 54 and 56, cross members 58 and 60 and other components can be made of individual pieces or formed integrally together from a single unitary body, if desired.

Toward the middle portion of panel assembly support 54 is a bore 62, which is accompanied by an equal and opposite bore 64 in the panel assembly support 56. Bores 62 and 64 create an axis when aligned with the axis 48 and 50 in the side support rails 32 and 34. Together the four bores 48, 50, 62 and 64 create the axis that the first panel 18 and its supporting structure can rotate about. There can be a hinge or pin type fastener (but not limited to only these forms) that keeps the axis of bores 62 and 64 of the panel assembly supports 54 and 56 and the axis or bores 48 and 50 of the side support rails 32 and 34 aligned and rotatably confined to a predicted path of movement limited by a mechanical stop.

The panel assembly supports 54 and 56 have an additional pattern of bores. The bores are located in close proximity to one another toward the top of the panel assembly supports 54 and 56. Bore 66 of the left panel assembly support 54 and bore 68 of the right panel assembly support 56 create an axis 70 for the support frame 14 and the rear leg assembly to pivot about. Next to the axis 70 in the left panel assembly support 54 is a second bore 72 that is located at an approximate 20 degree angle from the front face of the left panel assembly support 54 at a predetermined distance from the axis 70 and a third bore or slot 74 at approximately a 70 degree angle from bore 72 at the same predetermined distance. In the panel assembly support 56 is the exact same and equal pattern. The two bore patterns are in line with one another (bore 76 of the panel assembly support 56, being at 20 degrees and bore or slot 78 being at 70 degrees from bore 76).

Figure 7:
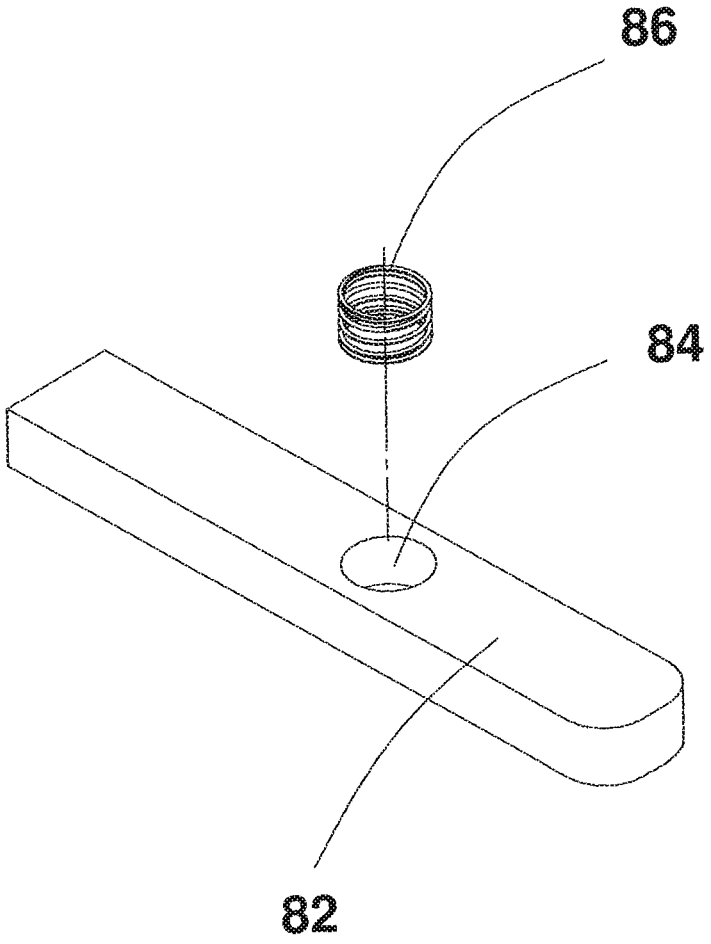
FIG. 7 is an exploded view of a locking key structure.

Each of the panel assembly supports 54 and 56 on the inside of the rails facing each other is a recessed portion 80 similar in size to the recessed portions 36 and 42 of the side support rails. The recessed portions 36 and 42 of the side supports of the panel assembly supports 54 and 56 are in alignment with each other when the first panel 18 is in a parallel alignment with the plane that each of the rear legs and panel assembly would create. Referring to FIG. 7, there is a key type structure 82 slidably encased between the two recessed portions of the panel assembly supports 54, 56 and the side support rails. The key type structure 82 has a round or bored recessed portion 84. Recessed portion 84 is meant to contain a pushing type device 86 such as but not limited to a spring. The spring 86 is allowed to be completely contained inside the key type structure 82. The key type structure 82 including the spring 86 can be completely contained in the recessed portions of the side support rails 32 and 34. Each of the side support rails 32, 34 contains the same key type structure 82 and spring 86. When each of the key type structures 82 and associated springs 86 are depressed into the side support rails 32 and 34 at the same time the entire first panel 18 and its support structure can be rotated so that the first panel 18 upper surface, 20 is completely inline or parallel with the support frame 14 front face. In one embodiment, the first panel 18 and its support structure is configured to have only two positions (however, this should not be considered limiting) which will be referred to as the open position or the closed position. For clarification purposes the open position is when the recessed portions of the side support rails 32 and 34 and the recessed portions of the panel assembly supports 54 and 56 align with each other in a parallel orientation and the key type structure 82 is allow to project into the recessed portions 80 of the panel assembly supports 54 and 56.

Each of the panel assembly supports 54 and 56, can be configured with a three sided structure which has the appearance of a "C" channel 88. The three sided structures 88 are fixedly attached to the inside surfaces and run parallel to surfaces 90 and 92 of the left and right panel assembly supports 54 and 56. The three sided structures 88 are located on the inside surface just above recessed portion 36 and 42. Both, of the three sided structures 88 face each other and are aligned in an equal and opposite position. It should be understood, two or more of these components can be integrally formed from a single unitary body. The three sided structures 88 create a slidable yet contained enclosure or track system for the two panels 94 and 96 to slide within only allowing a predicted liner motion. The removable sliding panels 94 and 96 can be secured in two (but are not limited to just two) positions. The panels 94 and 96 can be secured with a mechanical lock type mechanisms as needed or desired. The ability to move or remove the panels 94 and 96 is particularly advantageous because by removing either the top panel 96 or the bottom panel 94 or both panels the intensity or difficulty of the game can be altered.

Figure 9:
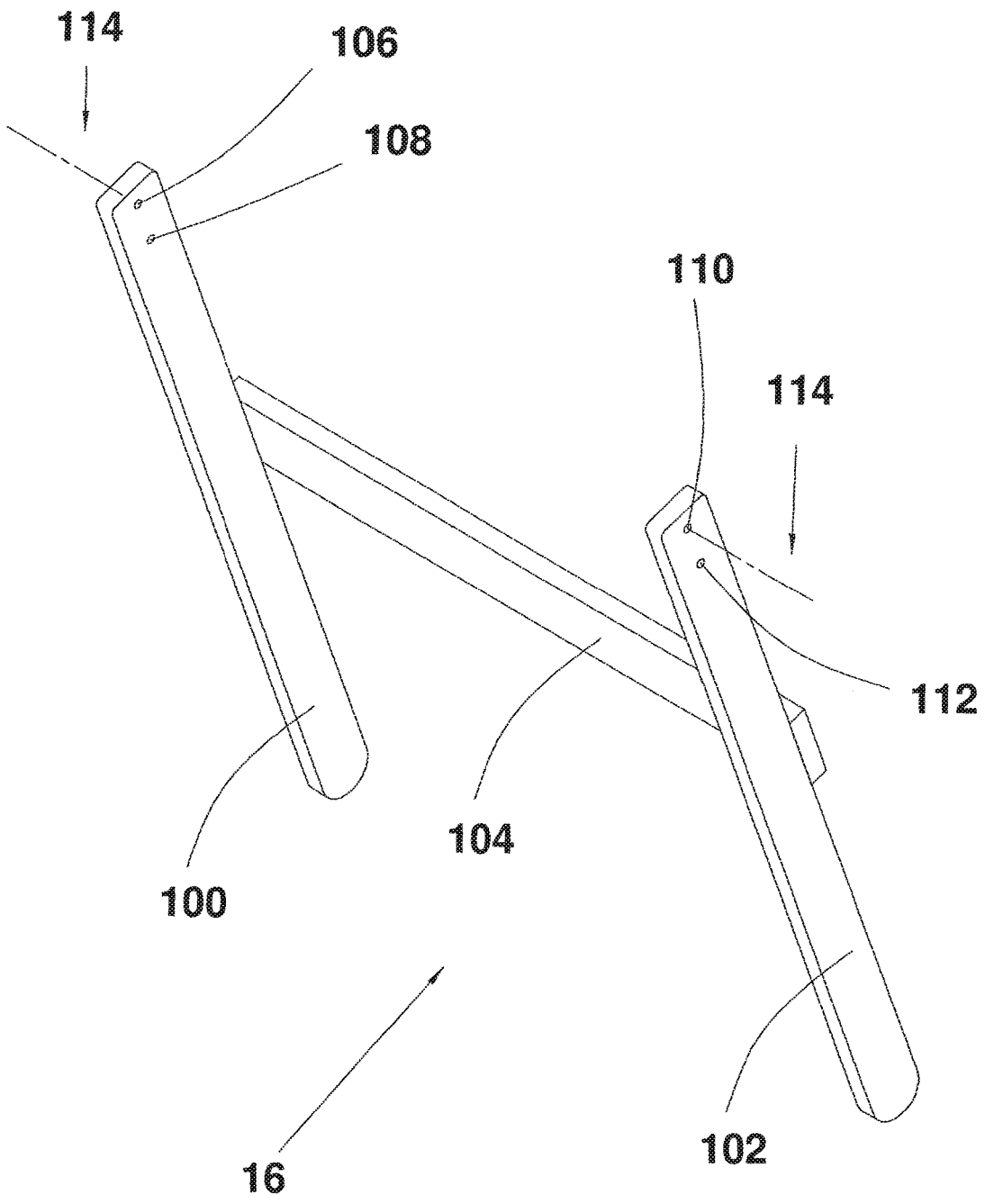
FIG. 9 is a perspective view of a rear support structure.

Referring to FIG. 9, the rear leg assembly 16 includes two rear vertical uprights 100 and 102. These two rear vertical uprights are angled slightly forward from a vertical orientation. Rear vertical uprights 100 and 102 are fixedly attached to a center cross member 104 which runs along the center portion of the two said rear vertical uprights 100 and 102. Typically, the two rear vertical uprights 100, 102 and the center cross member 104 are perpendicular to each other.

Toward the top of the vertical upright 100 is a pair of bored holes, where 106 is the upper bore and 108 is the lower bore. Toward the top of the vertical upright 102 is a pair of bored holes, where 110 is the upper bore and 112 is the lower bore. The bore 106 in the left, rear vertical upright 100 and the bore 110 in the right, rear vertical upright 102 create an axis 114. Axis 114 along with the axis 70 created by the bore 66 of the left panel assembly support 54 and bore 68 of the right panel assembly support 56 together create one combined axis for the panel assembly 12 and the rear leg assembly 16 to pivot or hinge about.

Figure 8:
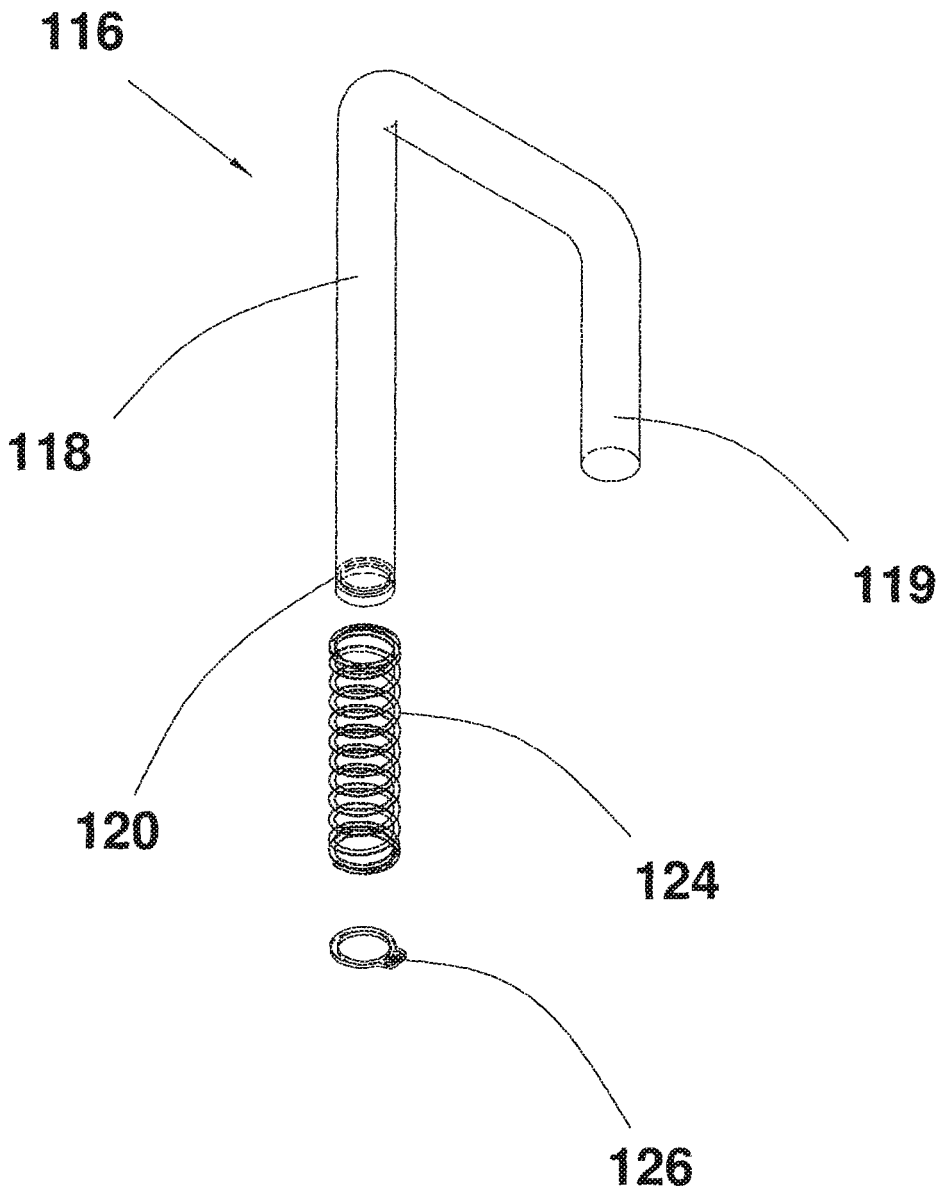
FIG. 8 is an exploded view of a locking pin assembly.

In the embodiment illustrated, the support frame 14 and the rear leg assembly 16 are held together by a locking pin assembly 116. Referring to FIG. 8, the locking pin assembly 116 can comprise, but is not limited to, two prongs or pins either made of a single piece bent in the shape of a "U" or a three piece assembly. One of the pins or prongs is somewhat longer then the other. The longer pin 118 has a groove 120 at the end of the pin that runs around the perimeter of the pin. The longer pin 118 of the locking pin assembly 116 is inserted into the axis 114 and travels through to axis 70 and protrudes out of the inner wall of the support frame 14 thereby creating a rotatable pivot for the support frame 14 and the rear leg assembly 16 to rotate about. The shorter pin 119 or prong is used as a locking mechanism between the support frame 14 and the rear leg assembly 16. The rear leg assembly 16 has a possibility of two positions that it can be locked in to; however, this should not be considered limiting. The first position is at an approximate 20 degree angle and can be achieved by lining up the shorter pin or prong 119 with the second set of bores 72 and 76 of the panel assembly supports 54 and 56 of the support frame 14. The second position which is at a 90 degree angle can be achieved by lining up the short pin or prong 119 with the third set of bores 74 and 78 of the panel assembly supports 54 and 56 of the support frame 14. The 20 degree angle is the typical position for the bag toss game and the 90 degree angle is the position that would be used to turn the game into a table as discussed below.

To turn the game into a table the pin assembly 116 is pulled in to a retracted position allowing the shorter pin or prong 119 to be removed from the panel assembly 12 thus allowing the rear leg assembly to pivot to its alternate position. The pin assembly 116 is retained by a pushing or pulling type device such as but not limited to a spring 124. The spring 124 applies a load to a retaining ring 126 (or some other type of retaining device) which draws the entire pin assembly 116 to a somewhat retained or locked position.

In an alternative configuration the locking pin assembly 116 could be replaced with dowel pins and the legs could be outfitted with mechanic bracing or the like.

Bag toss game assembly 10 can be used in multiple configurations. Bag toss game assembly 10 can be used in the upright position or it can be laid down upon the rear leg assembly to create a new game. When used in this configuration it may be helpful to use additional support legs 128 on the rear of the assembly. This game would be similar to a game referred to as cornhole or just bag toss. However, there is a significant difference in the bag toss game assembly 10 in that the panels 94, 96 can be removed or repositioned to change the difficulty of the game. In yet another configuration, the two bag toss assemblies 10 can be fastened together such as with brackets 130 and fasteners 132 to create a utility type table by relocating the rear leg assembly to a 90 degree position. The table could be used for other purposes such as but not limited to pong using the indicia 133 of markings so as to identify where containers such as cups can be placed into which a ping pong ball or the like can be tossed into. The connected panel assemblies can also be used as a utility table. Hence, the two bag toss assemblies 10 are not just one game, but rather at least three different games and a utility table. With multiple recreational uses such as camping, picnicking, etc.

Figure 10:
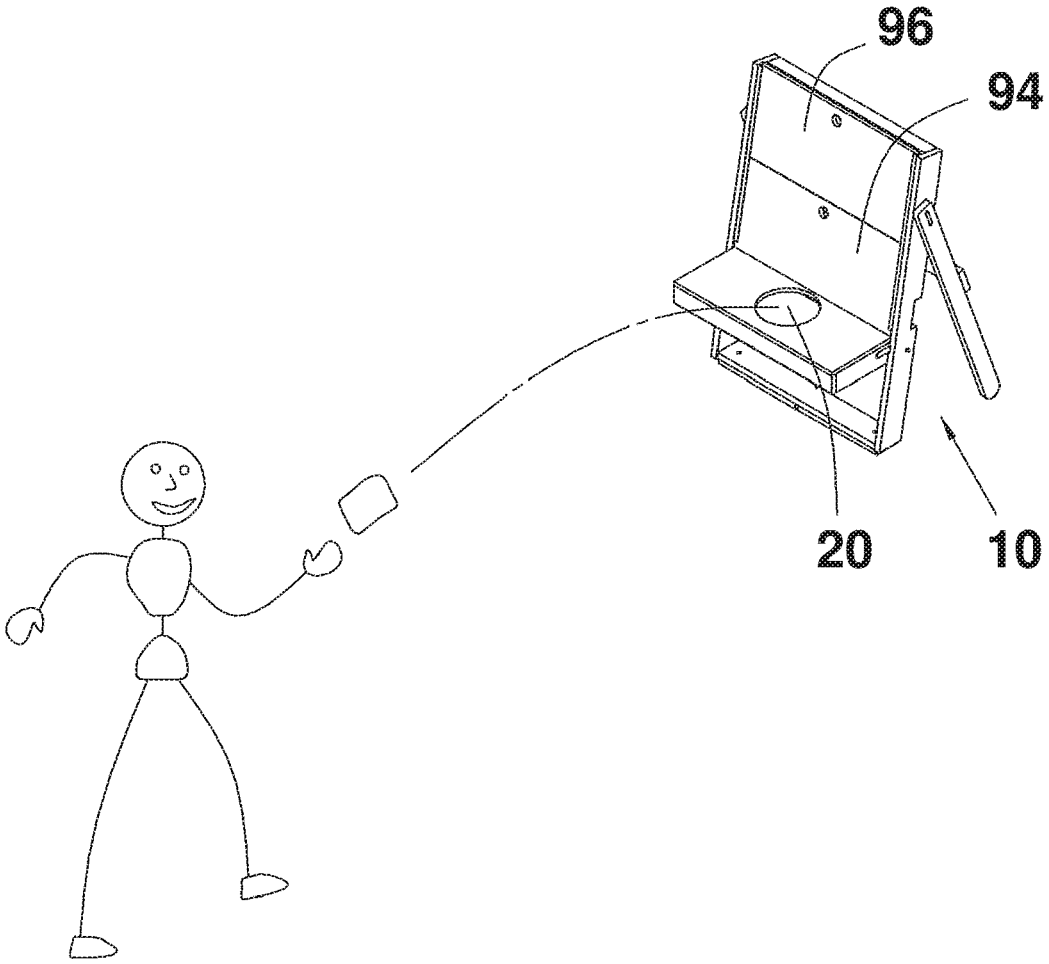
FIGS. 10-12 illustrate the panel assembly in alternative arrangements in a first configuration.
Figure 11:
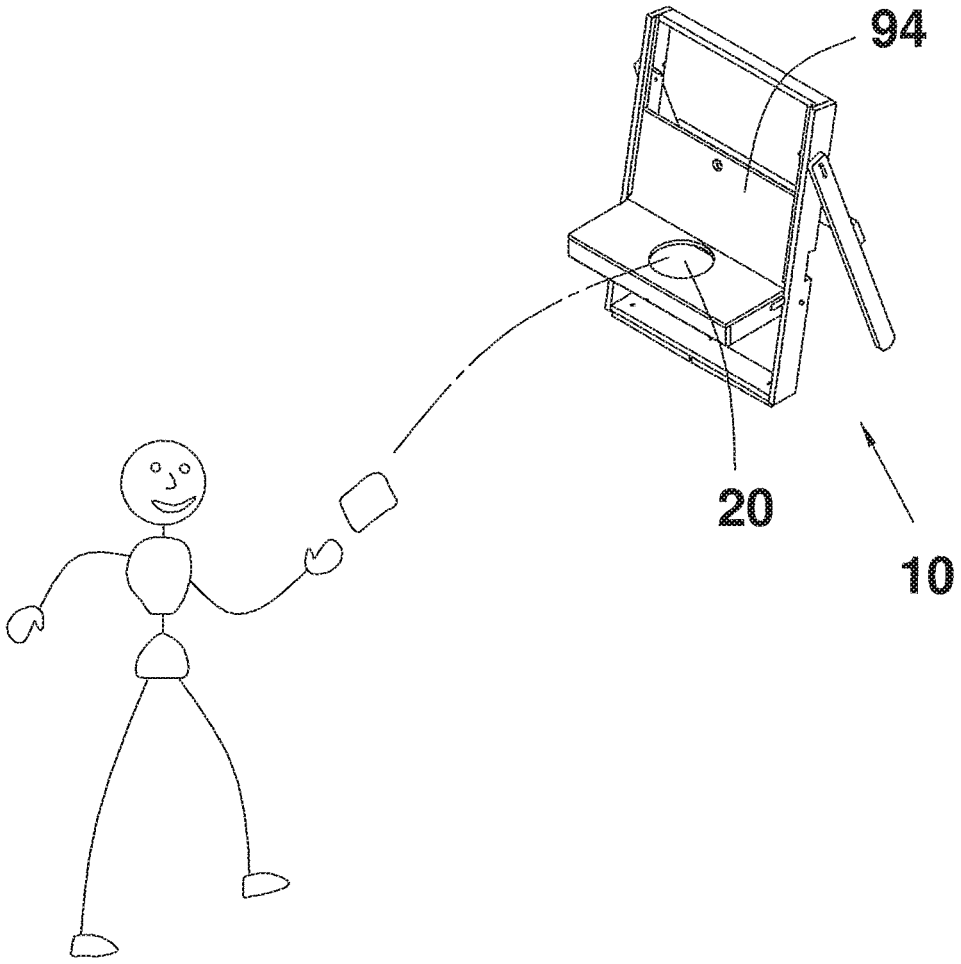
Figure 12:
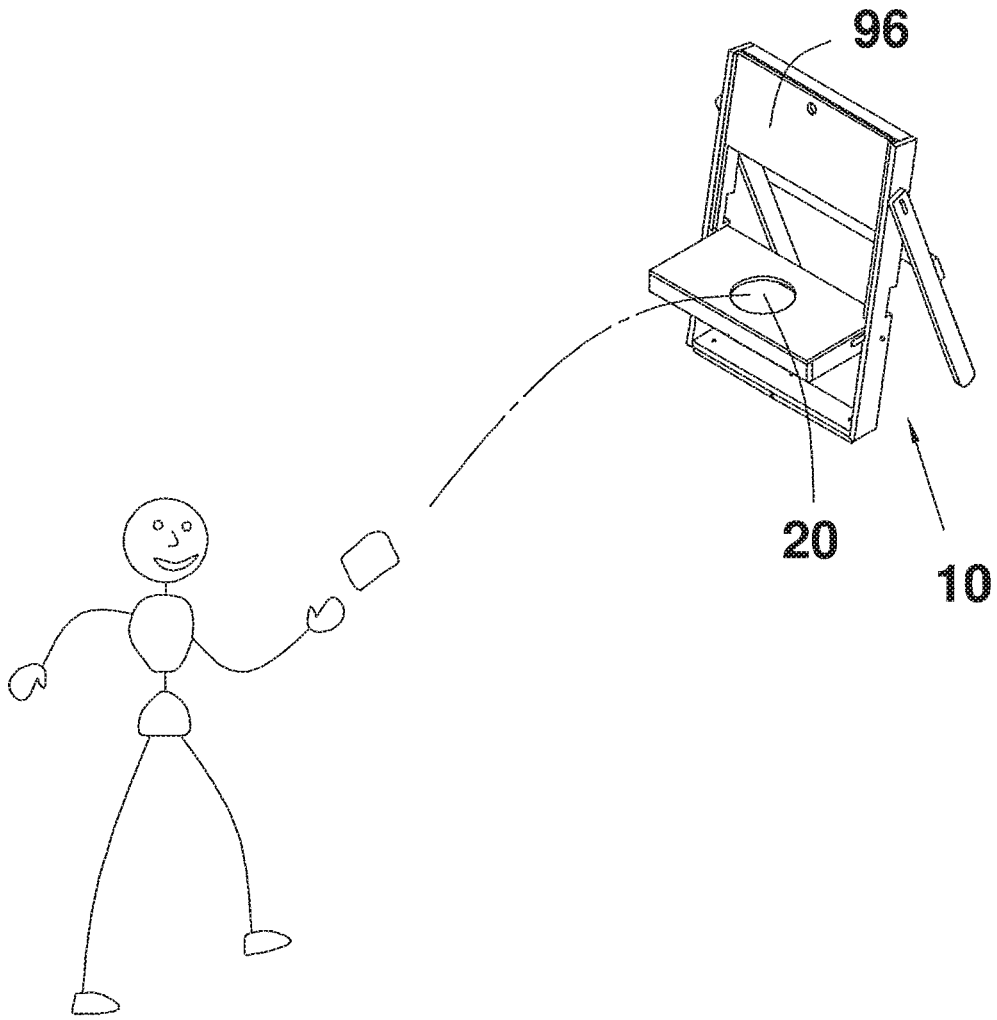

FIGS. 10-16 pictorially illustrate different alternative arrangement in various configurations. In FIG. 10, both panels 94 and 96 are used in a first arrangement of the assembly 10 in a first configuration, where in FIG. 11, top panel 96 has been removed in a second arrangement, while in FIG. 12, bottom panel 94 has been removed in a third arrangement.

Figure 13:
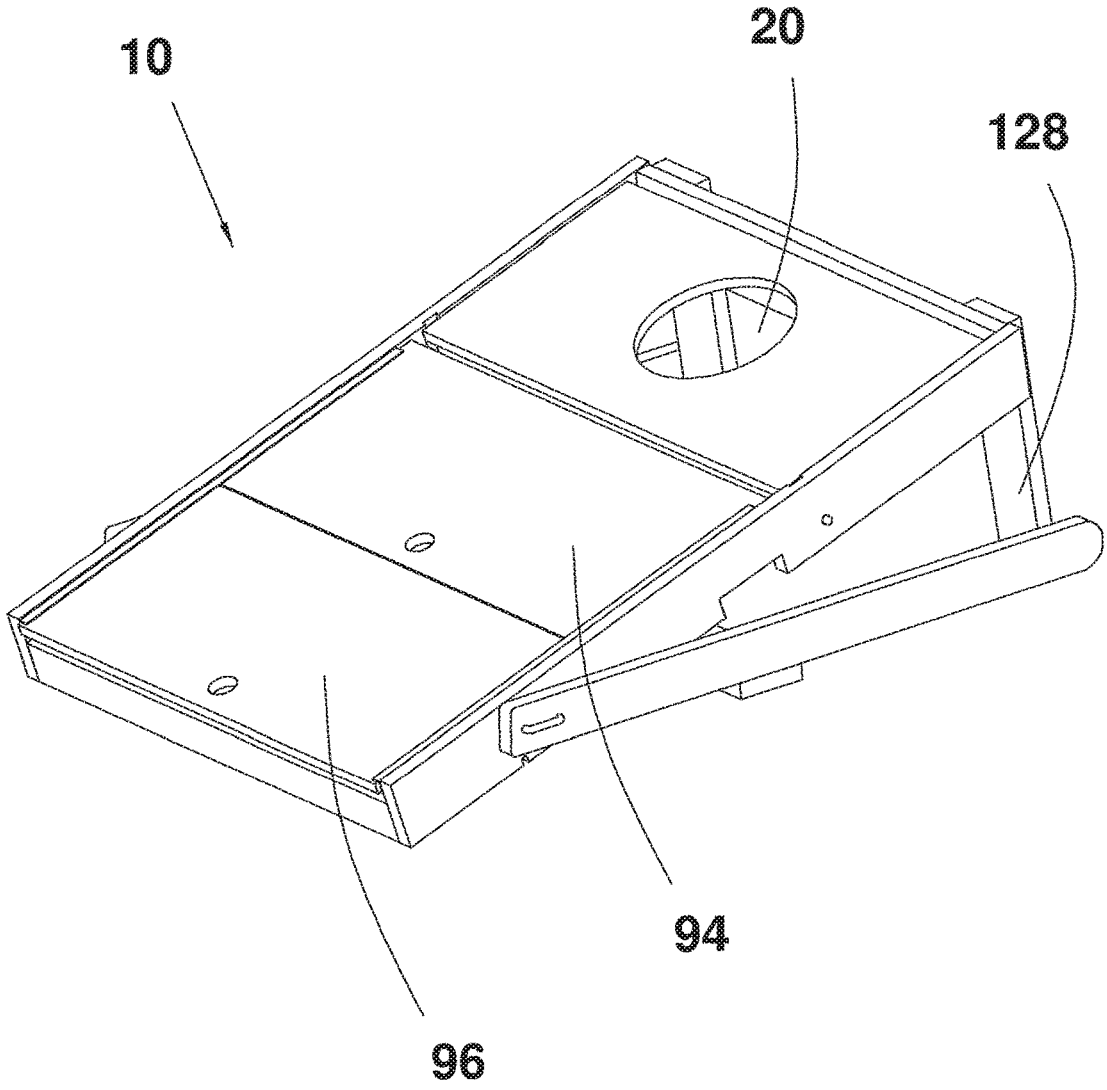
FIGS. 13-16 illustrate alternative arrangements of the panel assembly in a second configuration.
Figure 14:
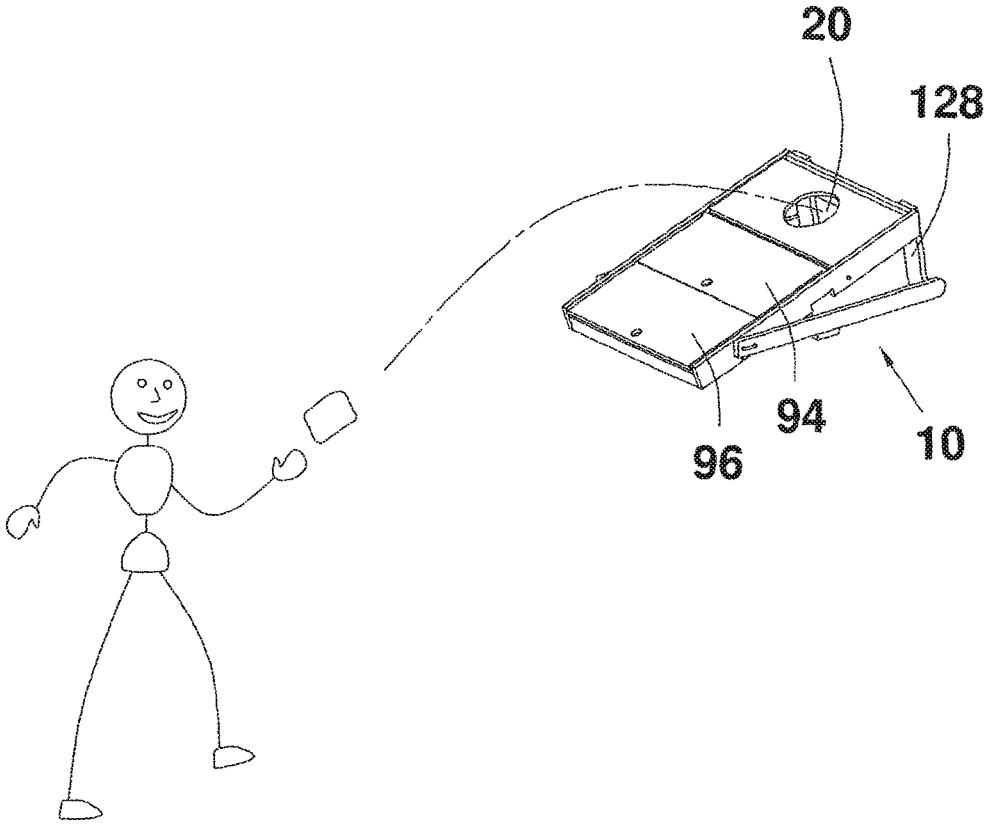
Figure 15:
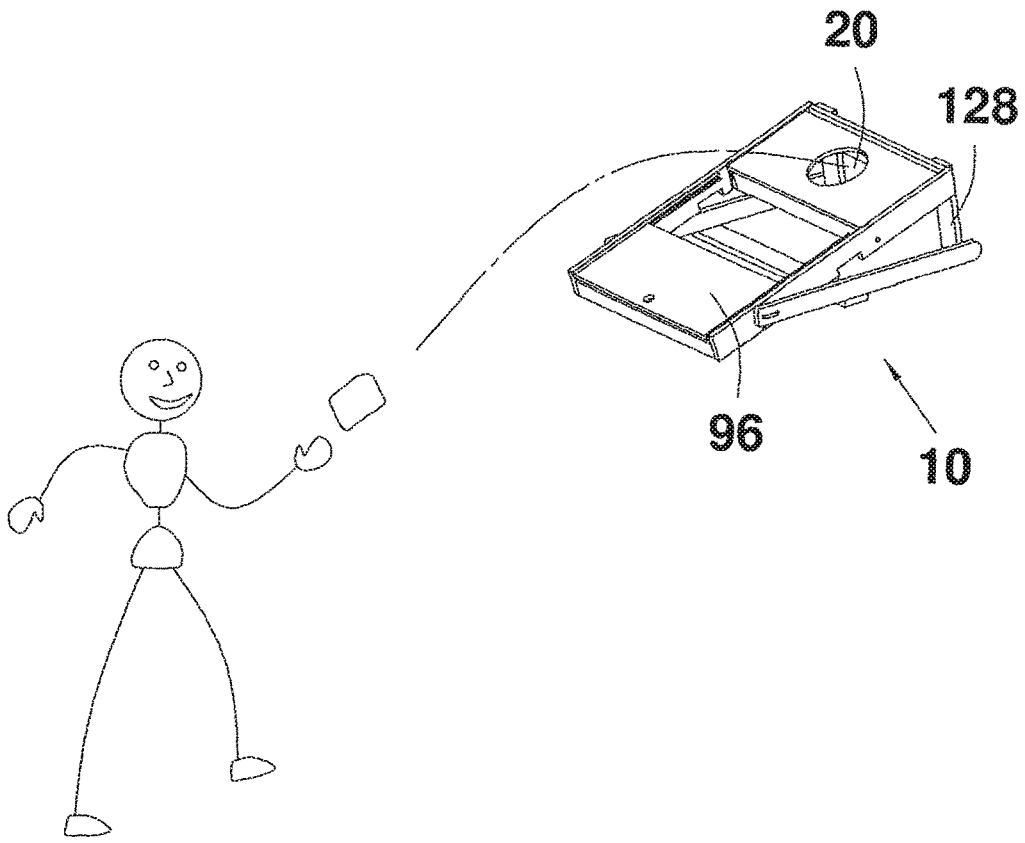
Figure 16:
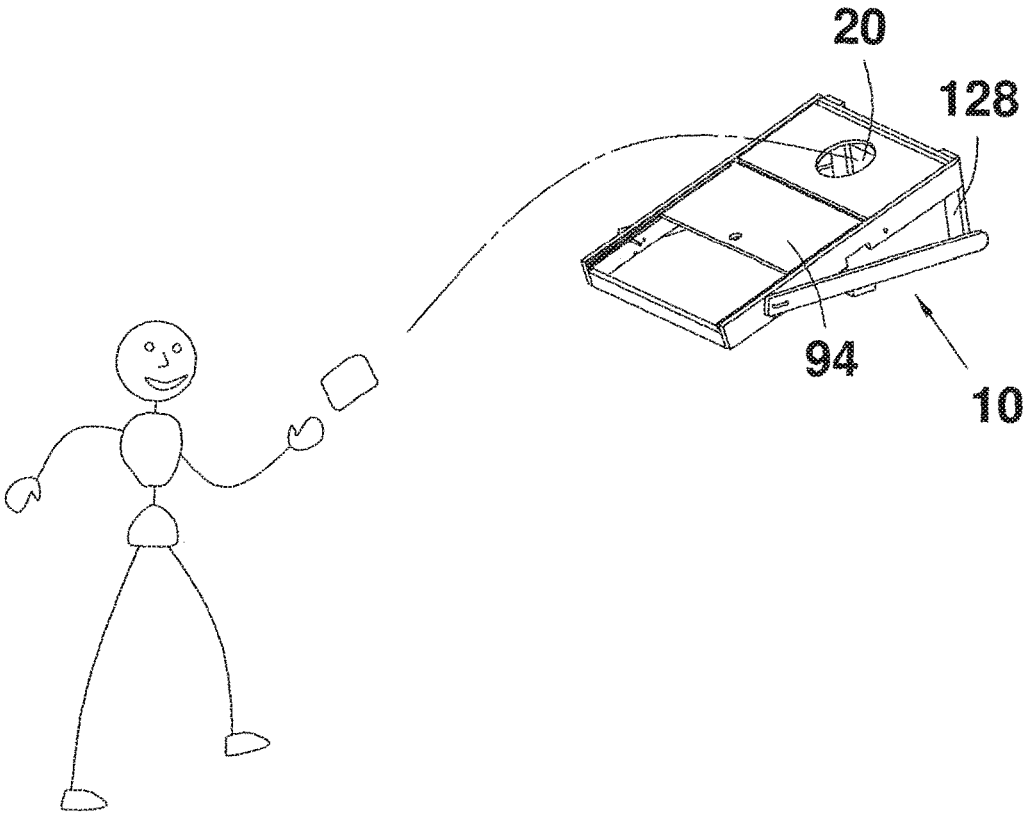

In FIGS. 13 and 14 both panels 94 and 96 are used in a first arrangement of the assembly 10 in a second configuration, where in FIG. 15 bottom panel 94 has been removed in a second arrangement, while in FIG. 16 top panel 96 has been removed in a third arrangement.

Figure 17:
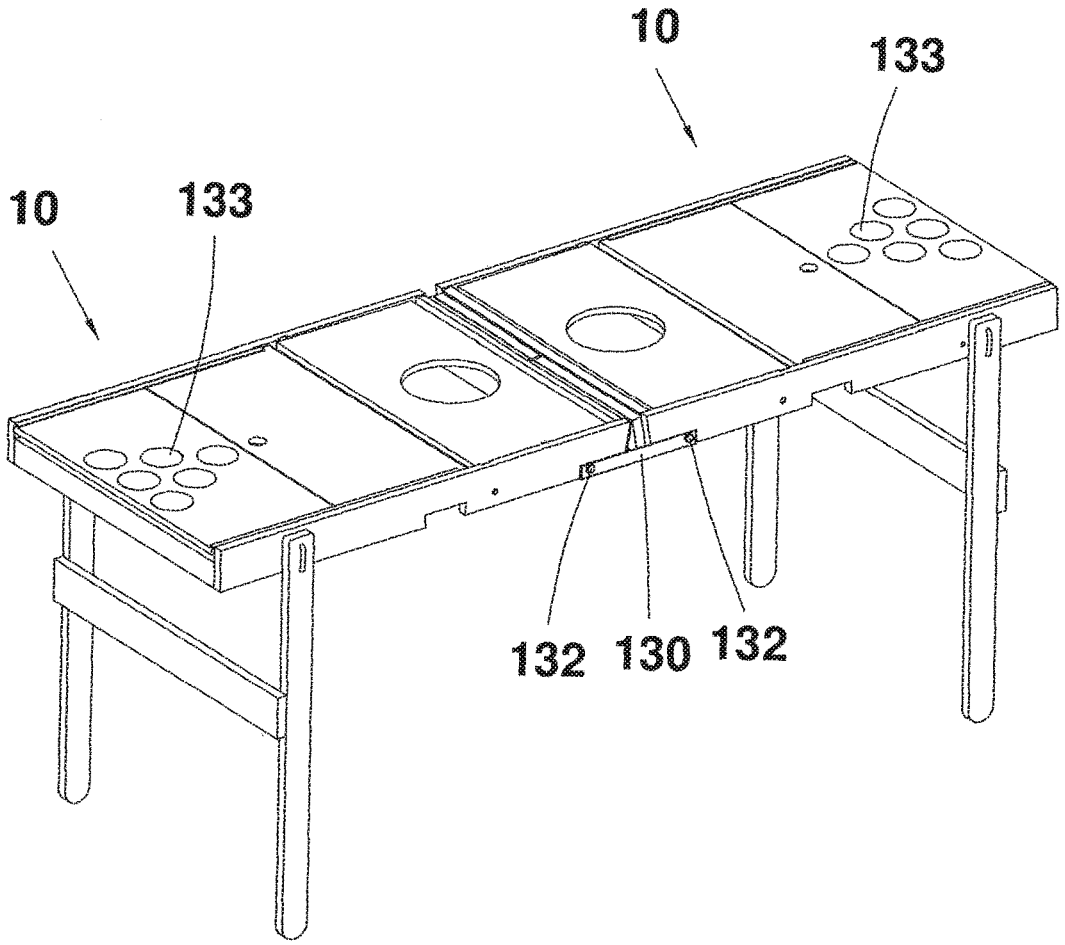
FIG. 17 illustrates two panel assemblies in a third configuration.

FIG. 17 illustrates a third configuration of the panel assemblies, where the panel assemblies 10 are joined together to provide a game or utility table.

Although the subject matter has been described in language specific to structural features and/or methodological acts, it is to be understood that the subject matter defined in the appended claims is not necessarily limited to the specific features or acts described above as has been determined by the courts. Rather, the specific features and acts described above are disclosed as example forms of implementing the claims.

What is claimed is:

1. A throwing game comprising:

a panel assembly including:

a support frame;

a first panel and a second panel supported by the support frame, the first panel having an aperture through a first major surface, the first panel and the second panel being supported by the support frame in two configurations:

a first configuration wherein the first panel extends from the support frame forming a platform with a free end and wherein a second major surface of the second panel is disposed above the first major surface and is oblique or perpendicular to the first major surface, and a second configuration wherein the first major surface of the first panel is coplanar with the second major surface of the second panel and wherein the first panel and second panel are adjustably spaced apart to vary a gap formed between side edges of the first major surface and the second major surface that face each other; and a panel assembly support connected to the panel assembly to support at least one end of the panel assembly off a ground surface.

2. The throwing game of claim 1 wherein the first panel pivots between the first and second configurations.

3. The throwing game of claim 1 wherein the first panel is removable from the panel assembly support when moved from the first and second configurations.

4. The throwing game of claim 1 and further comprising a second panel assembly including:

a second support frame;

a third panel and a fourth panel supported by the second support frame, the third panel having a second aperture through a third major surface, the third panel and the fourth panel being supported by the second support frame in two configurations:

a third configuration wherein the third panel extends from the second support frame forming a second platform with a second free end and wherein a fourth major surface of the fourth panel is disposed above the third major surface and is oblique or perpendicular to the third major surface, and a fourth configuration wherein the third major surface of the third panel is coplanar with the fourth major surface of the fourth panel and wherein the third panel and fourth panel are adjustably spaced apart to vary a second gap formed between side edges of the third major surface and the fourth major surface that face each other; and a second panel assembly support connected to the second panel assembly to support at least one end of the second panel assembly off the ground surface.

5. The throwing game of claim 4 wherein the panel assembly and the second panel assembly are configured to be connected together.

6. The throwing game of claim 5 wherein the panel assembly support and the second panel assembly support are configured to support the panel assembly and the second panel assembly when joined together in an elevated position above the ground surface.

7. The throwing game of claim 6 wherein the second panel and the fourth panel each includes indicia of a same pattern, and wherein indicia on the second panel of the panel assembly and indicia on the fourth panel of the second panel assembly are at remote ends of the throwing game in the elevated position.

8. A throwing game comprising:

a panel assembly including:

a support frame; and a first panel and a second panel supported by the support frame, the first panel having an aperture through a first major surface, and wherein the first panel and the second panel are selectively configurable on the support frame between two configurations:

a first configuration wherein the first and second panels are proximate each other with the first major surface being coplanar with a second major surface of the second panel, and a second configuration wherein the first major surface is coplanar with the second major surface and wherein the second panel is further from the first panel in the second configuration than in the first configuration.

9. The throwing game of claim 8 and further comprising a panel assembly support configured to hold the panel assembly in an inclined orientation off a ground surface in the first and second configurations.

10. The throwing game of claim 8 wherein the second panel is movable on the support frame.

11. The throwing game of claim 10 wherein the second panel slides on the support frame between the first and second configurations.

12. The throwing game of claim 11 and further comprising a third panel movably supported on the support frame.

13. The throwing game of claim 12 wherein the third panel slides on the support frame.

14. The throwing game of claim 13 wherein the second panel and the third panel slide in common channels of the support frame.

15. The throwing game of claim 8 and further comprising a third panel removably supported on the support frame.

16. A throwing game comprising:

a panel assembly including:

support frame;

a first panel and a second panel supported by the support frame, the first panel having an aperture through a first major surface, and wherein the first panel and the second panel are selectively configurable on the support frame between two configurations:

a first configuration wherein the first panel extends from the support frame forming a platform with a free end and wherein a second major surface of the second panel is disposed above the first major surface and is oblique or perpendicular to the first major surface, and wherein the first and second panels are proximate each other, and a second configuration wherein the first panel extends from the support frame forming the platform with the free end and wherein the second major surface of the second panel is disposed above the first major surface and is oblique or perpendicular to the first major surface, and wherein the second panel is further from the first panel in the second configuration than in the first configuration; and a panel assembly support connected to the panel assembly to support at least one end of the panel assembly off a ground surface.

17. The throwing game of claim 16 wherein the panel assembly support is pivotally connected to the support frame.

18. The throwing game of claim 16 wherein the second panel slides on the support frame between the first and second configurations.

19. The throwing game of claim 16 and further comprising a third panel removably supported on the support frame.

20. The throwing game of claim 16 wherein the first panel in the first configuration is oriented perpendicular to the second panel.

* * * * *